United States Patent [19]

Aoki et al.

[11] Patent Number: 4,788,832

[45] Date of Patent: Dec. 6, 1988

[54] REFRIGERATOR

[75] Inventors: Takashi Aoki, Kusatsu; Tatsuo Miyachi, Shiga, both of Japan

[73] Assignee: Matsushita Refrigeration Company, Osaka, Japan

[21] Appl. No.: 59,853

[22] Filed: Jun. 1, 1987

[30] Foreign Application Priority Data

Jun. 2, 1986 [JP] Japan ..... 61-127535

[51] Int. Cl.[4] ..... F25D 25/02

[52] U.S. Cl. ..... 62/382; 62/417; 62/441

[58] Field of Search ..... 62/382, 442, 441, 302, 62/417

[56] References Cited

U.S. PATENT DOCUMENTS 970,672 9/1910 Whittier ..... 62/417
2,161,983 6/1939 Swanson ..... 62/417 X
2,709,900 6/1955 Zearfoss, Jr. et al. ..... 62/382 X
3,357,201 12/1967 Toyama ..... 62/382

*Primary Examiner*—Lloyd L. King
*Attorney, Agent, or Firm*—Wenderoth, Lind & Ponack

[57] ABSTRACT

A refrigerator according to the present invention is so designed that the refrigerating chamber is divided by a partition plate into an upper cooling chamber and a lower cooling chamber in which a vegetable storing container in a sealed structure is accommodated, the vegetable storing container having a lid member attached with a humidity permeable film of gas permeability, whereby the humidity inside the vegetable storing container is maintained within a predetermined range suitable for preservation of vegetables, such that the vegetables are prevented from being dried to be withered and can be kept fresh for relatively a long period of time.

15 Claims, 5 Drawing Sheets

REFRIGERATOR

BACKGROUND OF THE INVENTION

The present invention relates to an electric refrigerator which is equipped with a vegetable storing box accomodated in a cooling chamber so as to stock vegetables therein in a fresh condition.

DESCRIPTION OF THE PRIOR ART

A prior art refrigerator has a refrigerating chamber divided into an upper cooling chamber and a lower cooling chamber by a partition plate, and vegetables are stocked in a vegetable storing box provided within the lower cooling chamber. Since the above-described prior art refrigerator has such construction that cold air is directly taken into the vegetable storing box from the upper cooling chamber through an air take-in port, the moisture transpired from the vegetables, particularly from green vegetables is carried away with the cold air, and therefore the green vegetables are dried and dehydrated, resulting in such disadvantage that the vegetables can be kept fresh for only a short period of time. Although it is proposed that the vegetable storing box is arranged to be tightly sealed so as to preserve the vegetables for a longer time, the arrangement is of completely tightly sealed structure, and accordingly the moisture transpired from the vegetables, particularly, from the green vegetables is undesirably condensed to dew drops and adhered onto the inner surface of a lid member covering an upper opening of the storing box. This is because the vegetable storing box is placed at the bottom section of the lower cooling chamber, and the cold air within the lower cooling chamber cools the outer surface of the lid member, while the vegetable storing box has high temperatures therein because of the respiration heat of the vegetables, thereby giving rise to a temperature difference between the outer and the inner surfaces of the lid member. Consequently, a lot of water drops adhered to the inner surface of the lid member drop naturally, or are dropped by the vibrations or the like caused when the vegetable storing box is taken in or out of the refrigerator, or the lid member is attached to or detached from the vegetable storing box, and finally the water drops gather on the surface of the stored vegetables or the bottom surface of the vegetable storing box. Therefore, although the vegetables can be preserved in a fresh condition for a first few days since the vegetables are prevented from being dried, it is disadvantageous that the vegetables are damaged to be rotten by the water drops gathering in the above-described manner. According to the prior art, the vegetables cannot be preserved for such a long time. Especially, in the case where fresh vegetables, in particular, green vegetables, are added into the vegetable storing box in addition to the vegetables which have been already stored in the refrigerator for some days, the already-stored vegetables suffer from sudden damage by the moisture transpired from the newly added vegetables, resulting in spoilage thereof.

SUMMARY OF THE INVENTION

An essential object of the present invention is to provide an improved refrigerator which is arranged to maintain the humidity inside a vegetable humidity or vegetable storing box placed in a cooling chamber, within a range most suitable for preservation of vegetables, such that the vegetables are preserved for a long period with the freshness thereof being maintained.

Another object of the present invention is to provide an improved refrigerator of the type referred to above which is arranged to prevent dew drops from being brought about on the inner surface side of the vegetable storing box.

A further object of the present invention is to provide an improved refrigerator of the type referred to above which is equipped with the vegetable storing box easy to be taken in or out of the cooling chamber.

In accomplishing these and other objects, according to the present invention, the refrigerator has the inside of its refrigerating chamber divided by a partition plate into an upper cooling chamber and a lower cooling chamber. A vegetable storing box is accommodated in the lower cooling chamber, which box is consisted of a box main body opened at the upper surface thereof and, a lid member covering the opening portion of the box main body. The refrigerator further includes a cold air convection path defined between the lid member covered with a film of gas permeability which can pass humidity therethrough and, the partition plate.

In the above-described construction, the water vapor generated as a result of transpiration or respiration of the stored vegetables is arranged to slip outside of the storing box moderately through the humidity permeable film, and accordingl it can be prevented that the water vapor is condensed into dew on the surface of the lid member, without substantial intrusion of the cold air directly into the storing box, resulting in such advantages that the vegetables in the storing box are properly controlled not to be dried up, and can be preserved for a long time.

BRIEF DESCRIPTION OF THE DRAWINGS

These and other objects and features of the present invention will be apparent from the following description taken in conjunction with preferred embodiments thereof with reference to the accompanying drawings, in which.

DESCRIPTION OF PREFERRED EMBODIMENTS

Figure 1:
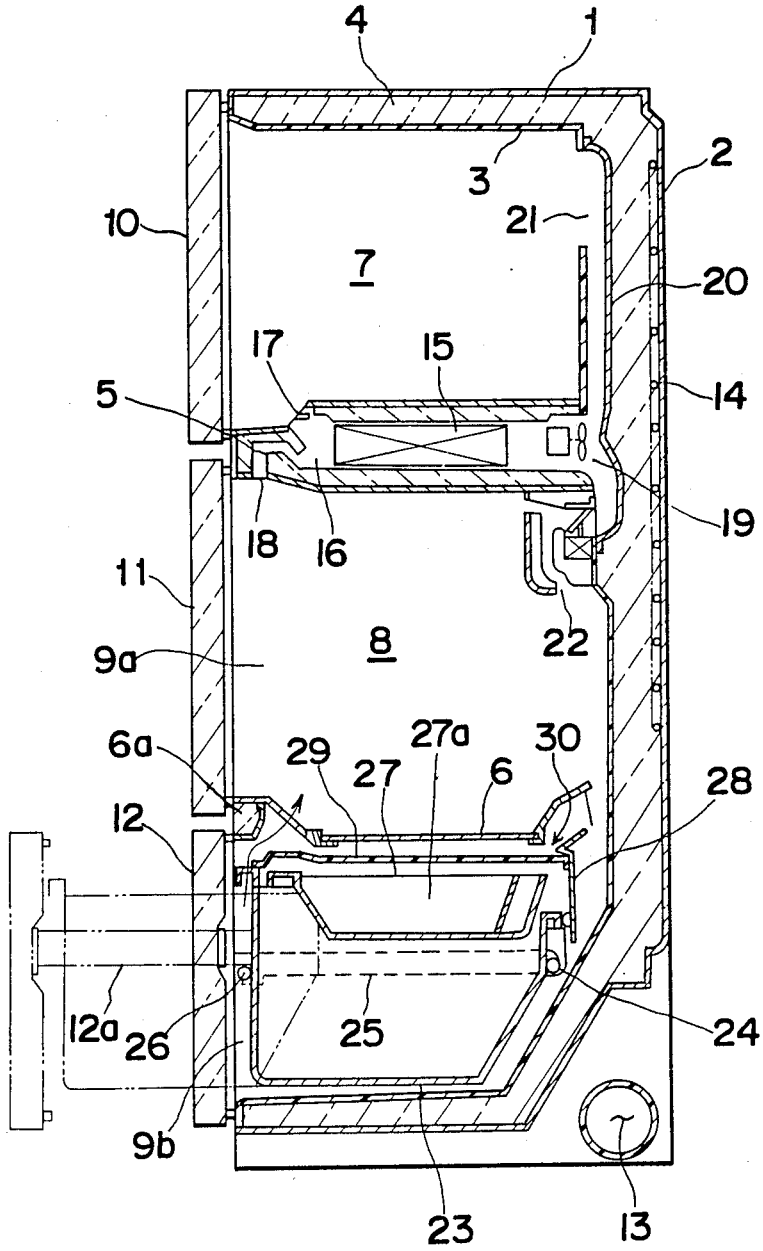
FIG. 1 is a cross sectional view of a refrigerator according to a first embodiment of the present invention.

Before the description of the present invention proceeds, it is to be noted here that like parts are designated by like reference numerals throughout the accompanying drawings.

Figure 2:
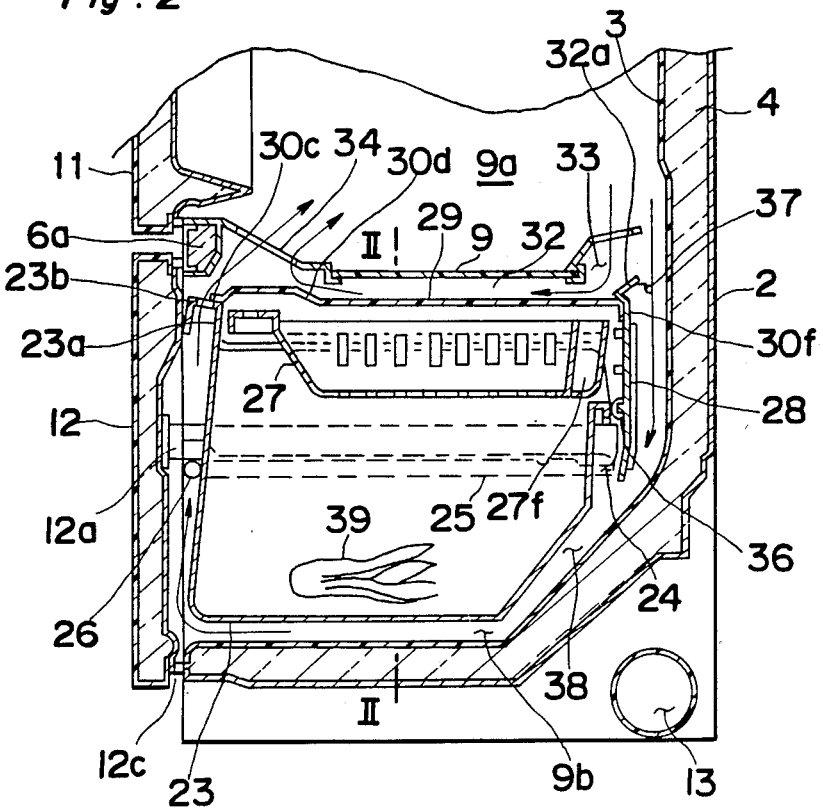
FIG. 2 is a longitudinal cross sectional view of a lower cooling chamber in the refrigerator of FIG. 1.
Figure 3:
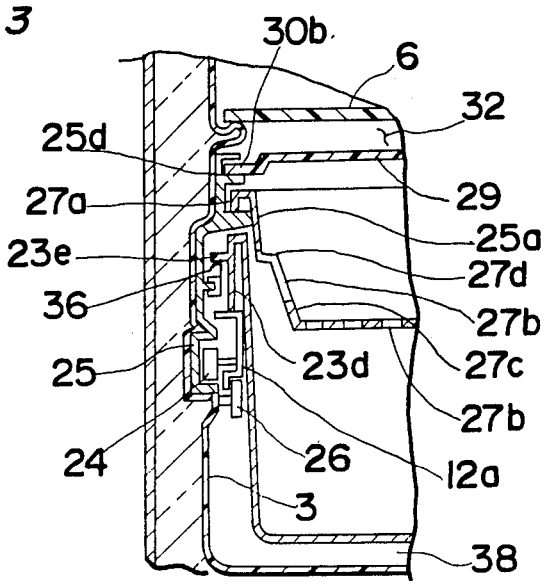
FIG. 3 is a cross sectional view taken along the line II—II of FIG. 2.

In FIG. 1, there is shown a refrigerator according to a first embodiment of the present invention. FIGS. 2 and 3 illustrate a lower cooling chamber of the refrigerator of FIG. 1. A refrigerator main body 1 is constructed by an outer box 2, an inner box 3 and an adiabatic material 4 inserted between the outer and inner boxes 2 and 3.

A storing chamber defined by the inner box 3 and opened at the front surface thereof is divided into a freezing chamber 7 and a refrigerating chamber 8 by an adiabatic partition wall 5. Moreover, the refrigerating chamber 8 is divided into an upper cooling chamber 9*a* and a lower cooling chamber 9*b* by a dividing member consisting of a partition plate 6 made of glass and synthetic resin, and an adiabatic support frame 6*a*. Each of these chambers 7, 9*a* and 9*b* is sealed at respective front openings by door members 10, 11 and 12, respectively, in a freely openable manner. The partition wall 5 forms a cold air path 16 arranged with a cooler 15 which, in conjunction with a compressor 13 provided at the bottom section of the main body and a condenser 14 placed at the back of the rear surface of the outer box 2, forms a freezing cycle. The cold air path 16 has take-in ports 17 and 18 formed at the upper and lower front end portions thereof so as to communicate with the freezing chamber 7 and the refrigerating chamber 8, respectively, therethrough. The cold air cooled by the cooler 15 is, through a duct 20 formed at the rear wall within the main body 1, sent into the freezing chamber 7 and the refrigerating chamber 8 by a fan 19 through respective outlets 21 and 22. There is provided a vegetable storing container 23 opened at the upper surface thereof for preserving the vegetables stored in the lower cooling chamber 9*b*. The vegetable storing container 23 is detachably mounted on a support frame 12*a* provided with the lower door member 12 which can be freely drawn in or out of the refrigerator. In the rear portion of each of the left and right edges of the support frame 12*a*, there is provided a roller 24 which is, as shown in FIG. 3, placed on a grooved supporting device 25 (hereinbelow referred to as a rail) formed in the lateral wall of the inner box 3 in a horizontal direction of the lateral wall. On the other hand, there is provided a roller 26 adjacent to a front opening at the lateral side wall of the inner box 3, onto which the under surface of the left and right edges of the support frame 12*a* is placed. Because of this construction, the support frame 12*a* is arranged to be freely taken out forward by the rail 25 and the roller 26. A separate small container 27 for storing the vegetables, etc. therein in a classified manner has a side flange 27*a* the front end of which is positioned backwards of an inner surface of a front wall 23*a* of the vegetable storing box 23 and which is supported by a support portion 25*a* integrally formed with the rail 25 in a position to close the upper opening of the box 23 within the upper peripheral edge portion of the box 23. Many through-holes 27*b* are formed at the bottom portion of the small container 27.

Figure 4:
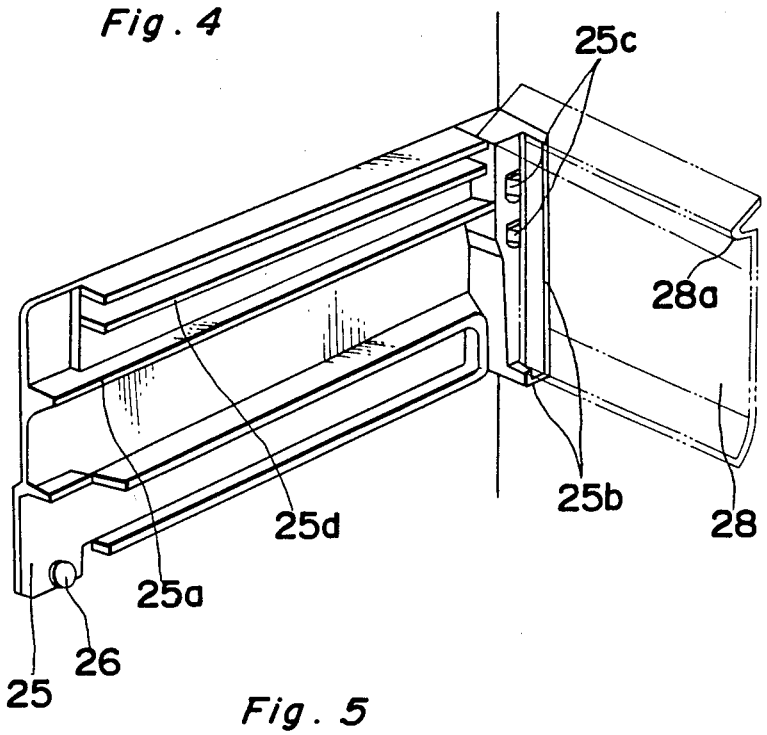
FIG. 4 is a perspective view of a guiding rail along which a vegetable storing box is taken in or out of the lower cooling chamber.
Figure 5:
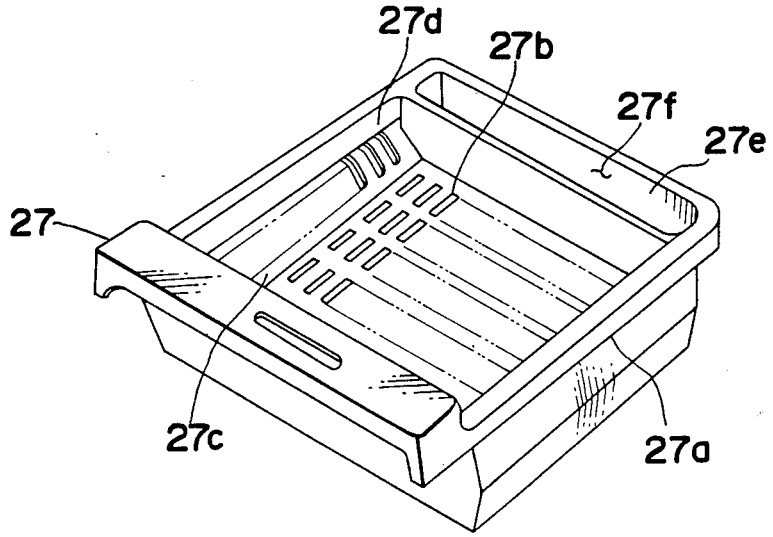
FIG. 5 is a perspective view of a small box in the vegetable storing box of FIG. 2.
Figure 6:
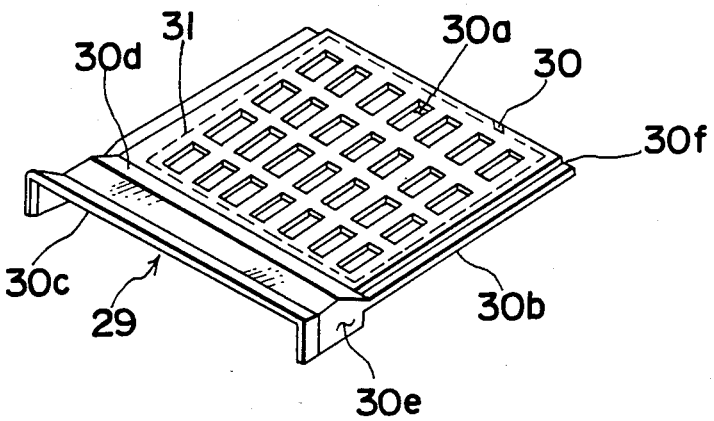
FIG. 6 is a perspective view of a lid member of the vegetable storing box of FIG. 2.

As shown in FIG. 4, a covering member 28 made of an adiabatic material and positioned in the rear of the containers 27 and 23 is fixedly adhered to the rail 25 provided in the opposite lateral walls of the inner box 3 by a receiving portion 25*b* and a claw member 25*c*. Furthermore, a lid member 29 is consisted of a flat plate 30 made of synthetic resin and having many through-holes 30*a*, flanges 30*b* at the opposite ends of the flat plate 30 and a humidity permeable film 31 held through deposition (or through a separate member) on the surface of the flat plate 30 confronting the container 27, as seen from FIGS. 6 and 7. The lid member 29 has, as shown in FIG. 3, each of the flanges 30*b* at the opposite ends thereof supported by receiving portion 25*d* which is integral with the rail 25. At the front end portion 30*c* of the lid member 29 is formed a cold air guide 30*d* inclining towards a cold air returning passage 32. The front end portion 30*c* is mounted on a peripheral edge 23*b* which is formed through extension of the vegetable storing container 23 at the front surface thereof, with the opposite side portions at the front end of the lid member forming a flange portion 30*e* which covers over a receiving part 25*a* of the rail 25. A deep end portion 30*f* of the lid member is tightly contacted with a bent portion 28*a* at the upper end of the covering member 28, such that the vegetable storing container 23 and the small container 27 are brought into approximately sealed condition against the first cold air convection path 32 defined by the partition plate 6 above the lid member 29. The cold air is taken into the first cold air convection path 32 through a cold air take-in part 33 and, is taken back through a returning port 34 formed in the support frame 6*a* made of adiabatic material.

A seal material 35 is pressed into contact with an outer peripheral edge of the flange in the interior of the vegetable storing container 23. The covering member 28 is covered with the seal material 35, while, on the other hand, the rail 25 is provided with a seal material 36 in such manner that the vegetable storing container 23 is, when it is accommodated in the lower cooling chamber, pressed into contact with the seal materials 35 and 36, in conjunction with a rib 23*e* provided in a horizontal direction to an outer peripheral edge 23*d* of the flange at each of the opposite sides of the container 23, in a vertical direction. The cold air entering the lower cooling chamber 9*b* from a second cold air take-in port 37 defined between the deep wall of the inner box 3 and the rear surface of the covering member 28 is passed through a second cold air convection path 38 formed between the outer periphery of the vegetable storing container 23 and the inner box 3 to be sent back to the upper cooling chamber 9*a*, together with the cold air from the first convection path 32, through the cold air returning port 34 in the adiabatic support frame 6*a*.

Detailed explanation will be given hereinbelow of the aforementioned humidity permeable film 31 with reference to FIG. 7. The humidity permeable film 31 is a layered member which is composed of a basic cloth 31*a* made of fibrous layers of polyester or nylon, etc., a thin film 31*b* made of silicon resin having several microns' or several tens microns' thickness and integrally formed with the basic cloth 31*a* thereon, and a protective fivrous layer 31*c* made of hydrophilic nylon fiber so as to prevent the breakage of the silicon resin thin film 31*b* and also the dew condensation. The degree of the humidity permeability of the humidity permeable film 31 is adjusted mainly by changing the thickness of the silicon resin thin film 31*b*.

In other words, the silicon resin thin film is composed largely of amorphous chain molecular assembly having an interval of 10–$10^3$ Å between molecules, such that the collective member completely shuts off liquid, while displaying gas permeability. Accordingly, if the density difference exists between inside and outside of the film, vapor, air or carbonic acid gas can be passed through the thin film 31*b*. From this, it is understood that changing the thickness of the silicon resin thin film will adjust the degree of the humidity permeability of the film 31. Moreover, the permeability degree of the film 31 can be more or less adjusted by changing the thickness or the weaving form of the basic cloth 31*a* and the protective fibrous layer 31*c*.

In the above-described construction, the rotation of the fan 19 and the freezing cycle composed of the compressor 13, the condenser 14 and the cooler 15, cools the freezing chamber 7 and the refrigerating chamber 8 down to a predetermined temperature. At this time, the cold air is prevented from directly invading into the vegetable storing container 23 and the small container 27 because of the presence of the covering member 28 and the lid member 29. Since the small container 27 is communicated with the vegetable storing container 23 through the through-holes 27*b*; there is given rise to no temperature difference between the two containers 27 and 23. Accordingly, each of the containers 27 and 23 is kept uniformly high in humidity with the moisture transpired from the vegetables 39 by the lid member 29 sealed by the upper surface of the small container 27. On the other hand, the small container 27 has, in addition to the through-holes 27*b*, a bypass 27*d* with a stepped portion formed in the lateral peripheral edge 27*c* of the container so as to let the moisture pass therethrough, and a bypass air path 27*f* formed in the rear peripheral edge 27*e* of the container which communicates the vegetable storing container 23 with the lid member 29. Therefore, even if the bottom portion of the small container 27 is hidden with vegetables or the like, it does not make any inconveniences.

Figure 7:
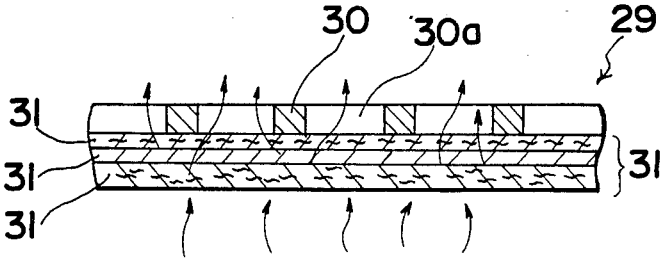
FIG. 7 is a cross sectional view of an essential portion of the lid member of FIG. 6, on an enlarged scale.

The moisture over the saturated humidity in each of the containers 27 and 23 is, as shown in FIG. 7, permeated. In other words, the cold air from the upper cooling chamber 9*a* is arranged to be taken in from the first and second take-in ports 33 and 37. However, the first cold air convection path 32 is shorter than the second cold air convection path 38 running in the outer periphery of the container 23, and therefore receives smaller resistance from the air. Furthermore, the cold air guide 30*d* provided at the front end portion 30*c* of the lid member 29 avoids the collision of the cold air running in the first cold air convention path 32 with that running in the second convection path 38, with guiding the former to the cold air returning port 34. Therefore, the moisture is moderately passed into the upper cooling chamber 9*a* which is low in humidity, through the humidity permeable film 31 on the surface of the lid member 39 which is most cooled with much convection amount in the first cold air convection path 32. Moreover, in consequence to this, the moisture is prevented from being confined to the rear surface of the partition wall 6 to be dew-condensed.

Meanwhile, in addition to the fact that the convection amount in the second cold air convection path 38 is reduced, since the containers 23 and 27 are covered with the covering member 28, the temperatures at the rear portion of each of the containers 23 and 27 do not become much low, resulting in no temperature difference between inside and outside of each of the containers, without dew produced on the inner surface of each of the containers.

The humidity permeable film 31 is able to hold the humidity thereof at 80–90% RH which is considered to be suitable for preservation of vegetables.

It is to be noted here that the silicon resin thin film 31*b* may be replaced with such thin film as fine porous film made of TEFLON (polytetrafluoroethylene, trademark of E. I. Dupont and De Nemours Corp.) or polyurethane having the same humidity permeability.

Figure 8:
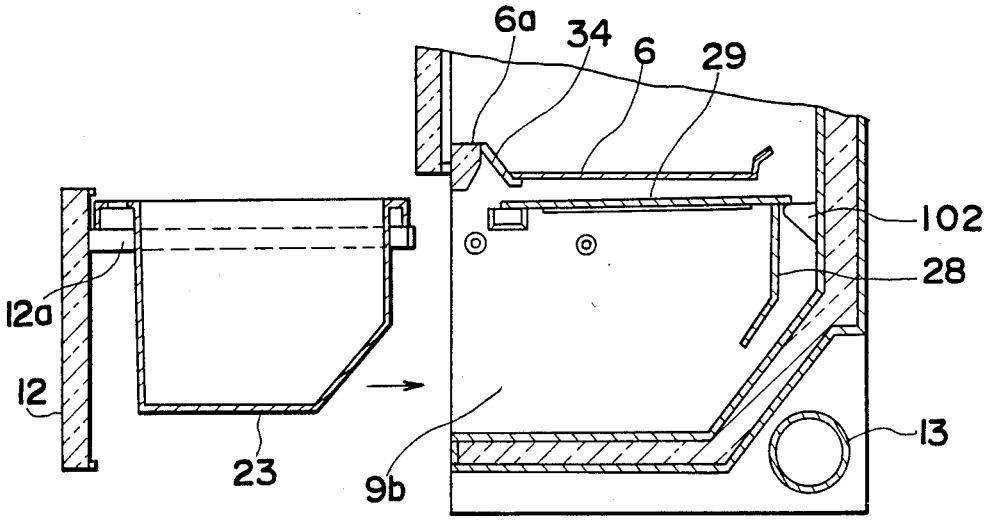
FIG. 8 is a cross sectional view of a lower cooling chamber of a refrigerator according to a second embodiment of the present invention.
Figure 9:
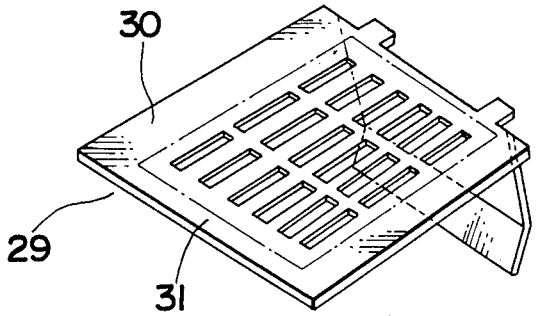
FIG. 9 is a perspective view of a lid member of a vegetable storing box of FIG. 8.

A refrigerator according to a second embodiment of the present invention will be described with reference to FIGS. 8 and 9, which is different from the refrigerator of the first embodiment in that the covering member 28 is integrally formed with the lid member 29 in the rear portion of the flat plate 30 in such manner that it confronts the rear surface of the vegetable storing container 23 and extends in a downward direction. Because of this covering member 28, the cold air sent from the upper cooling chamber 9*a* is prevented from directly hitting the rear surface of the vegetable storing container 23 which is accordingly prevented from being partially cooled.

The lid member 29 is supported by the receiving part 25*d* of the rail 25 provided in the side walls of the inner box, and therefore it does not happen that the lid member 29 is drawn out in association with the movement of the vegetable storing container 23 when the container is taken in or out of the lower cooling chamber 9*b*. When the door member 12 is opened to take the vegetable storing container 23 out of the refrigerator, the upper surface of the container 23 is in an opened state, which facilitates the vegetables to be stored into or taken out of the container 23.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A refrigerator comprising:

a refrigerating chamber;

a partition plate in said refrigerating chamber for dividing said refrigerating chamber into an upper cooling chamber and a lower cooling chamber;

a vegetable storing container including a container main body having an upper opening at the upper surface thereof, a lid member covering said upper opening of said container main body, said lid member being a synthetic resin flat plate having a plurality of through-holes, a gas-permeable humidity-permeable film attached to said flat plate for covering said through-holes, and said vegetable storing container being accommodated within said lower cooling chamber; and a cold air convection path defined between said lid member and said partition plate for fluidly communicating said container main body of said vegetable storing container with said upper cooling chamber.

2. A refrigerator comprising:

a refrigerating chamber;

a partition plate in said refrigerating chamber for dividing said refrigerating chamber into an upper cooling chamber and a lower cooling chamber;

a vegetable storing container including a container main body having an upper opening at the upper surface thereof, a lid member covering said upper opening of said container main body, said lid member including a humidity-permeable film having gas permeability for allowing gases through said lid member, and said vegetable storing container being accommodated within said lower cooling chamber; and a cold air convection path defined between said lid member having said humidity-permeable film and said partition plate, and being defined between said vegetable storing container and an inner wall of said lower cooling chamber, for fluidly communicating said vegetable storing container and said lower cooling chamber with said upper cooling chamber.

3. A refrigerator as claimed in claim 1, wherein said humidity permeable film comprises fibrous layers at the opposite sides thereof, with a silicon resin thin film having gas permeability inserted between said fibrous layers.

4. A refrigerator which comprises:

a refrigerating chamber divided into an upper cooling chamber and a lower cooling chamber by a partition member;

a cold air take-in port provided in the rear of said partition member so as to communicate said upper cooling chamber with said lower cooling chamber;

a cold air returning port provided in the front of said partition member so as to communicate said upper cooling chamber with said lower cooling chamber;

a vegetable storing container accommodated in said lower cooling chamber and including a container main body opened at the upper surface thereof, and a lid member covering said upper opening of the main body, said lid member being provided with a humidity permeable film having gas permeability;

a first cold air convection path defined between said lid member and said partition member so as to run from said cold air take-in port to said cold air returning port; and a second cold air convection path defined between said container main body and the inner wall of said lower cooling chamber from said cold air take-in port, along the rear surface, bottom surface and front surface of said container main body, to said cold air returning port.

5. A refrigerator as claimed in claim 4, further comprising a covering member placed in the second cold air convection path adjacent to the cold air take-in port for covering the rear surface of the container main body.

6. A refrigerator as claimed in claim 4, wherein said covering member is integrally formed with said lid member in the rear portion of the lid member in such manner as to confront the rear surface of the container main body and extend downwardly to be positioned in the second cold air convection path.

7. A refrigerator as claimed in claim 4, wherein a cold air guide having a slope is provided in the front end portion of said lid member so as to guide the cold air running in the first cold air convection path to the cold air returning port.

8. A refrigerator as claimed in claim 4, wherein said lid member is consisted of a flat plate made of synthetic resin and having many through-holes, and the humidity permeable film attached to said flat plate so as to cover said through-holes.

9. A refrigerator as claimed in claim 8, wherein said humidity permeable film is a layered member which is composed of fibrous layers and a silicon resin thin film having gas permeability.

10. A refrigerator which comprises:

a refrigerator main body consisting of an outer box, an inner box and an adiabatic material filled between the outer and the inner boxes;

a refrigerating chamber composed of said inner box and opened at the front surface thereof;

an upper cooling chamber divided from a lower cooling chamber by a partition member in said refrigerating chamber;

a door member which closes said opening in the front surface of said upper and lower cooling chambers in a freely openable manner;

a support frame held at one end thereof on the rear surface of said door member closing the front opening of said lower cooling chamber, and guided by a support device in a manner to be freely drawn in or out, said support device being provided at the opposite side walls of the inner box forming said lower cooling chamber;

a container main body for preserving vegetables therein which is opened at the upper surface thereof and mounted on said support frame so as to be drawn into or out of the refrigerator in association with the closing or opening of the door member;

a lid member provided with a humidity permeable film having gas permeability for covering said upper opening of the container main body;

a cold air take-in port formed in the rear portion of said partition member so as to communicate said upper cooling chamber with said lower cooling chamber;

a cold air returning port formed in the front portion of said partition member so as to communicate said upper cooling chamber with said lower cooling chamber;

a first cold air convection path defined between said lid member and said partition member and running from said cold air take-in port to said cold air returning port;

a second cold air convection path defined between said container main body and said inner box forming said lower cooling chamber and running from said cold air take-in port to said cold air returning port along the rear surface, the bottom surface and the front surface of said container main body; and a covering member placed in said second convection path adjacent to said cold air take-in port so as to cover the rear surface of said container main body.

11. A refrigerator as claimed in claim 10, wherein said lid member is consisted of a flat plate made of synthetic resin and having many through-holes, and the humidity permeable film attached to said flat plate in such manner as to cover said through-holes.

12. A refrigerator as claimed in claim 11, wherein said humidity permeable film is consisted of fibrous layers and a silicon resin thin film having gas permeability.

13. A refrigerator as claimed in claim 11, wherein a cold air guide having a slope is provided in the front end portion of said synthetic resin flat plate constituting the lid member so as to guide the cold air running in the first cold air convection path to the cold air returning port.

14. A refrigerator as claimed in claim 10, wherein said lid member is supported by a receiving part integrally formed with said supporting device, with the front end portion thereof and the rear end portion thereof being in contact with the peripheral edge of the front opening of the container main body and the covering member, respectively.

15. A refrigerator as claimed in claim 10, wherein a small container opened at the upper surface thereof is provided in the upper opening portion of said container main body, said small container being able to be drawn out independently in the state where the container main body is drawn out.

* * * * *